United States Patent [19]

Plescia

[11] Patent Number: 4,696,219

[45] Date of Patent: Sep. 29, 1987

[54] NUT FOR STRINGED INSTRUMENTS

[76] Inventor: Ralphael Plescia, 1048 California Ave., Salt Lake City, Utah 84104

[21] Appl. No.: 839,899

[22] Filed: Mar. 14, 1986

[51] Int. Cl.[4] ..... G10D 3/04; G10D 3/06; G10D 3/12

[52] U.S. Cl. ..... 84/314 N; 84/299; 84/302

[58] Field of Search ..... 84/298–302, 84/307–311, 314 N

[56] References Cited

U.S. PATENT DOCUMENTS

| | | | |
|---|---|---|---|
| 647,506 | 4/1900 | Merrill | 84/308 |
| 698,955 | 4/1902 | Jackson | 84/309 |
| 1,397,193 | 11/1921 | Wilson | 84/302 |
| 1,604,573 | 10/1926 | Hawkinson | 84/307 |
| 2,475,055 | 7/1949 | Schuh | 84/310 |

FOREIGN PATENT DOCUMENTS

| | | | |
|---|---|---|---|
| 1490 | of 1907 | United Kingdom | 84/302 |
| 182622 | 7/1922 | United Kingdom | 84/309 |
| 593227 | 10/1947 | United Kingdom | 84/302 |

*Primary Examiner*—Lawrence R. Franklin

*Attorney, Agent, or Firm*—Thorpe, North & Western

[57] ABSTRACT

An improved nut design for positioning near the fingerboard of a stringed instrument or at the opposing anchor ends of the strings of the instrument comprising a nut body having a raised string support column for each respective string and a fluted or open space between each column for enhancement of sound transfer into the resonating body of the instrument. The modification of the nut body to form a crown with alternating support columns and open spaces has been found to substantially improve sound transfer and tone production. The nut configuration has been adapted for the nut body positioned at the upper end of the fingerboard, and also for the saddle and tail piece for stringed instruments of the violin family.

17 Claims, 14 Drawing Figures

NUT FOR STRINGED INSTRUMENTS

BACKGROUND OF THE INVENTION

1. Field of the Invention

This invention pertains to that portion of a stringed instrument referred to as the nut. More specifically, the present invention relates to an improvement in the design configuration of the nut which develops improved sound transfer through the nut or other string support items positioned at extreme ends of the instrument such as the tail piece and saddle.

2. Prior Art

The bridge of stringed instruments has long been the focus of design innovation with the objective of improving sound transfer into the body of the instrument. It is generally believed that the bridge, sound post (positioned within the body of the instrument) and the instrument body itself constitute the critical parts of sound generation in such instruments as violins, violas, cellos, guitars, banjos, etc.

A great variety of bridge design has developed and is represented by the following patents. U.S. Pat. No. 1,783,117 by Gosparlin and U.S. Pat. No. 2,446,267 by Dahn show conventional F-holes slightly modified to improve sound transfer. U.S. Pat. No. 642,416 by Beetem illustrates a multipiece bridge in which each string is separately supported by a post. U.S. Pat. No. D. 43,358 by Goodyear depicts an artistic design for a bridge having separate columns or support members for each string of the instrument mounted on a common base. U.S. Pat. No. 1,852,509 by Dolan proposes a bridge that suspends the strings on a support cord journalled across support columns on the bridge. Finally U.S. Pat. No. 2,343,384 by McDonald discloses curved fingers that project upward to support individual strings, each finger being tailored in size to relate to the depth of pitch for the intended string.

Although the extremes of design represented by the above cited patents suggest many directions of innovation, virtually all commercial bridge design has retained the traditional configuration of a single, integral body having F-holes within the bridge body and having an uninterrupted crown of moderate curvature to support the strings. For banjos and guitars, the crown of the bridge is a flat configuration, uninterrupted by slots, F-holes or the like. No significant interest or effort has been extended toward modifying other parts of the stringed instrument for improving sound quality, such as with the nut, saddle and tail piece.

Generally, the nut of a stringed instrument is the raised ledge at an upper end of the instrument neck over which the strings pass and are suspended in raised relation to the fingerboard or frets. A typical nut configuration is shown in FIG. 1. The nut body 10 comprises a single piece of ebony, wood, plastic or other hard material which has a front face 11, back face 12, side faces 13 and 14, base 15 and a crown 16. The front face typically butts against a top end of the fingerboard (not shown in FIG. 1). The base is configured to provide for a snug fit of the nut with respect to the neck of the instrument. The side walls may be decorated with flourishment but have not been considered as serving any other significant purpose.

The primary function of the nut has been to suspend the strings of the instrument over the fingerboard. Accordingly, the crown 16 is typically adapted with small grooves 17 cut diagonally as shown to provide a seat for the supported strings. This positioning factor has been the only design consideration applied toward innovation of the nut.

For example, two U. S. patents have issued dealing with nut modifications. U.S. Pat. No. 2,309,082 by Smith discloses a nut for a guitar which is slotted with two sets of slots for varying the height of the strings above the frets. The shallow slots or groove function in a traditional manner, while the deeper slots allow string positioning very close to the frets at the base of the slots. U.S. Pat. No. 3,599,524 by Jones shows an arrangement of multiple nut pieces which can be displaced along the string for purposes of fine tuning.

It is not surprising that those skilled in the art would disregard the nut of the instrument when seeking to improve sound production. Logically, there should be little effect for sound transfer from the strings through the nut. It is generally acknowledged that placement of a finger on the string would stop vibration of the string, except between the bridge and the finger. Indeed, the purpose of the fingerboard or fret is to enable reduction of effective string length which is subject to vibration and thereby increase the frequency or pitch. In short, vibration of the strings is dampened by depression to the fingerboard or frets and should therefore defeat sound transfer into the nut. Furthermore, sound vibrations in a stringed instrument are amplified through the resonant body of the instrument. Therefore, any vibration energy passing into the nut would have to travel the length of the neck before adding effect to the total resonant output. Perhaps these considerations have contributed to a clear disregard for improved design of the nut for a stringed instrument over the past several hundred years.

OBJECTS AND SUMMARY OF THE INVENTION

It is an object of the present invention to provide an improved nut for a stringed instrument which enhances the sound produced by vibration of the strings.

It is a further object of this invention to provide a nut which transfers vibration energy from the supported strings into the neck and body of the instrument.

It is an additional object of this invention to adapt other terminal string supports of the instrument such as the saddle and tail piece with structure that enhances the sound production of the instrument.

Yet another object of this invention is to provide design modifications for the fingerboard and other parts of the instrument which can complement modifications to the nut to further enhance sound production.

These and other objectives are realized in an improved nut for positioning near the fingerboard of a stringed instrument wherein the nut comprises a nut body having front, back and side faces, and a crown adapted to support the strings at a proper position with respect to the fingerboard. The crown of the nut is formed of two separate alternating sections. The first section comprises the string support means positioned at an appropriate height above the level of the fingerboard for proper string positioning. The second section of the nut comprises a fluted portion wherein most of the space between (i) the two adjacent strings, (ii) the front and back nut faces and (iii) the level of the fingerboard and level of the strings is void of nut material. These first and second sections form alternating string support posts and spacer gaps therebetween. In this configuration, the vibration from the string passes effectively through the nut and into the neck for transfer to the resonating body. These same design principles can be applied to extreme anchor points of strings of an instrument such as the nut, saddle, and tail piece. Similarly, both the nut and the anchoring bridge of the guitar may be adapted with this modified configuration to improve sound production.

Other objects and features of the present invention will be apparent to those skilled in the art in view of the following detailed description, taken in combination with the following drawings.

DETAILED DESCRIPTION OF THE INVENTION

Despite longstanding contrary beliefs of many skilled artisans in the field of violin and guitar making, the present inventor has discovered that a surprising and dramatic improvement of sound quality occurs with stringed instruments which have the nut modified with a flute or large groove between string supporting points. Significant improvements also arise where other string support structure at string ends is similarly modified such as with the saddle and tail piece. These parts of the string instrument have heretofore been treated as passive structure substantially insignificant toward the production of improved sound quality.

Figure 2:
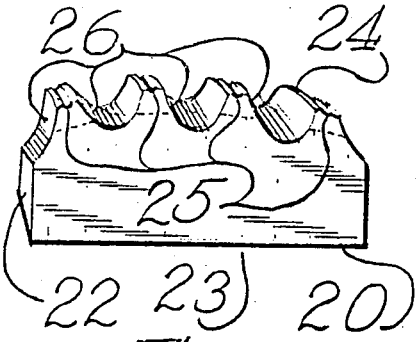
FIG. 2 is a front perspective view of a violin nut designed in accordance with the present invention.

One embodiment of a modified nut is shown in FIG. 2. The nut body includes a front face 20 for placement near or proximate to the fingerboard mounted to a neck portion of the instrument. A back face 21 and two side faces 22 form the periphery of the nut and are configured with the base 23 to have a snug fit with respect to the neck and fingerboard of the instrument.

The crown 24 of the nut is specially formed to include two separate parts or sections. The first section is represented by item 25 and consists of a plurality of string support columns or means. Generally, these support means position and retain the strings at properly spaced distances with respect to adjacent strings and above the fingerboard. The second section of the crown is represented by the plurality of items 26 forming flutes or deep grooves imposed in the crown of the nut between the respective string support points. Also included in this definition of second section members are the lateral flutes which merge into or form part of the side wall structure 22.

Figure 3:
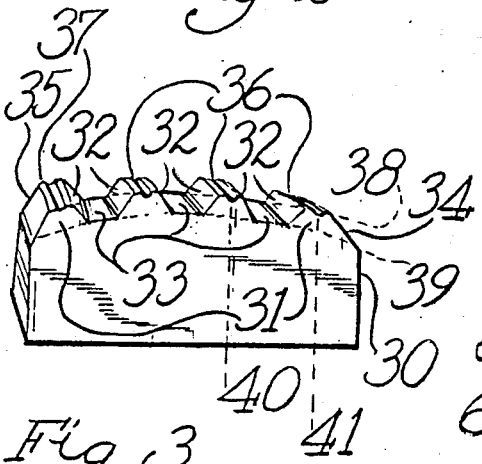
FIG. 3 is a front perspective view of a nut modified with a different configuration for improving sound transfer.

The flutes of most figures are shown to be arcuate in shape; however, it will be apparent to those skilled in the art that many configurations could be selected which implement the invention herein disclosed. For example, FIG. 3 illustrates a squared embodiment of a nut wherein the crown 30 is made up of support column 31 formed between converging side walls 32. These side walls 32, in combination with a base 33, define the second section or open space which alternates between the respective string supports.

The inventor has discovered that by removing nut material from between the supported strings, a surprising improvement in sound quality occurs. The more material removed, the better the tone is produced. The amount of material removed is limited by the need for strong support to the string. It has also been noted that diverging walls of the support columns offer better results than a straight or nonslanted wall. It would appear that the vibrational transfer occurring from the string into the instrument is enhanced by a megaphone or amplification effect of the diverging structure.

The string support means 31 includes a string groove 36 to ensure that the taut string remains seated in its proper position. The intermediate space between the support columns extends as close to the string groove 36 as possible, without resulting in weakened support structure. Accordingly, a small shoulder 37 remains on each side of the groove, balancing the need for strength against the preferred removal of maximum nut material between the strings.

Referring again to FIG. 3, the second section or space may be quantitatively defined as comprising a fluted portion or volume contained between several boundary conditions. Upper and lower boundary levels are defined by the string level 38 and fingerboard level 39. Side boundaries consist of the front and back faces of the nut and two imaginary planes 40 and 41 passing through the two adjacent strings or grooves. For preferred nut performance, most of the space within this contained volume is void of nut material. In otherwords, most of this volume comprises open space. This condition may exist as a single space in the nut, but would preferably be structured between each of the strings as illustrated in the drawings.

In addition, lateral portions of the nut 34 and 35 adjacent to each of the two outside grooves or strings are configured as second sections or cutaway sections of nut. Quantitatively, this lateral second section comprises a fluted portion wherein most of the space between (i) the single string or groove 41 and the adjacent face 42, (ii) the front and back nut faces and (iii) the fingerboard 39 and string 38 levels is void of nut material.

Figure 1:
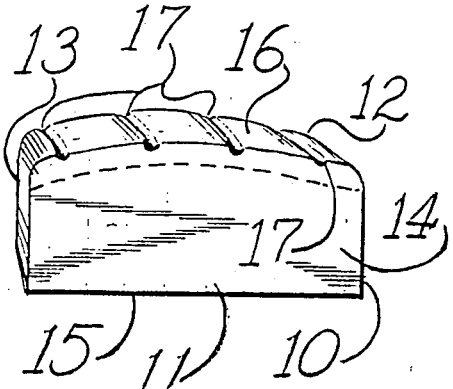
(Prior Art) Fig 1
FIG. 1 is a front perspective view of a violin nut of conventional configuration and identified as prior art material.
Figure 4:
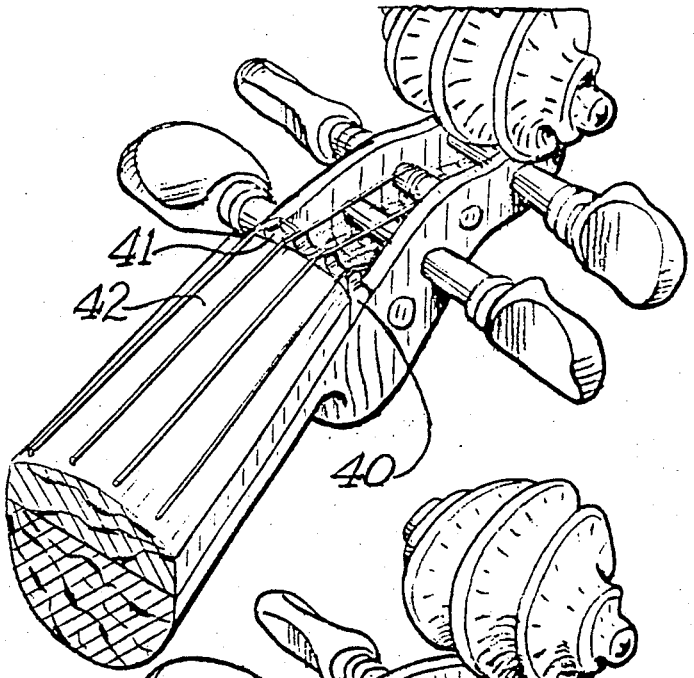
FIG. 4 is a perspective view of an upper section of fingerboard, nut, tuning pegs and scroll of a stringed instrument having a nut modified in accordance with the present invention.
Figure 5:
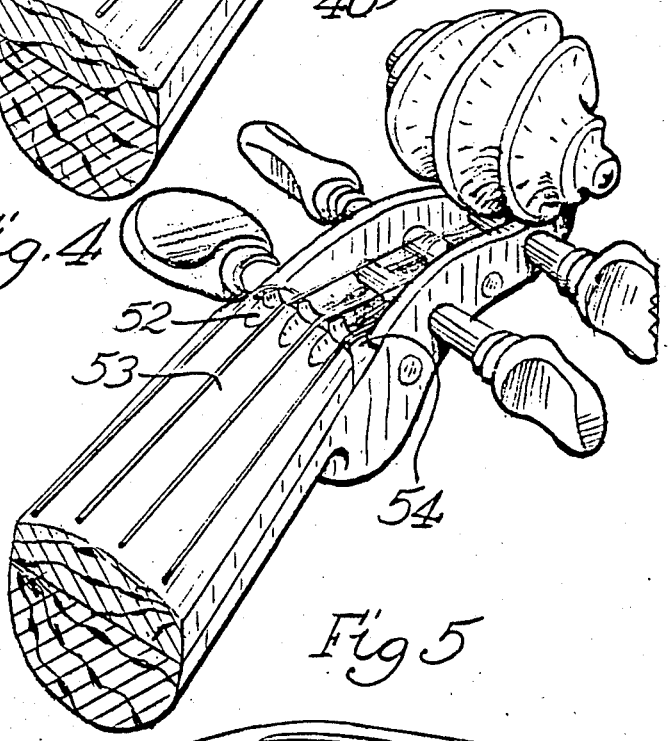
FIG. 5 is a perspective view of an upper section of fingerboard, nut, tuning pegs and scroll of a stringed instrument having a nut and fingerboard modified in accordance with the present invention.
Figure 6:
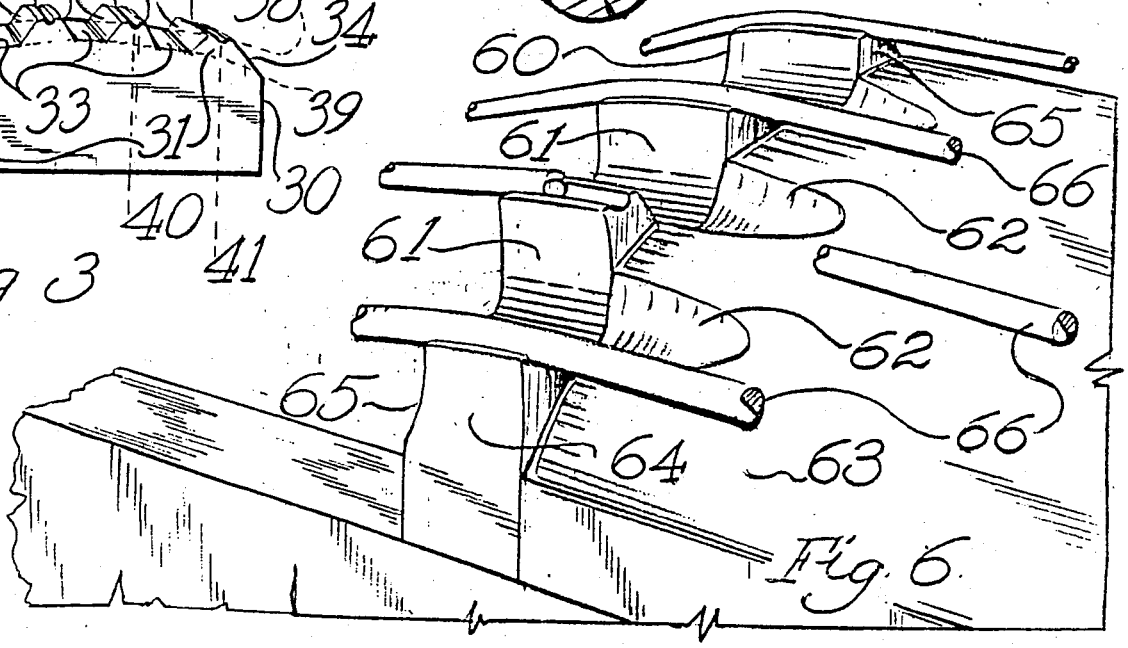
FIG. 6 is an enlarged perspective view of the nut of FIG. 5 with supported strings.

From the performers perspective, an arcuate flute as shown in FIGS. 2, 4, 5 and 6 is aesthetically more pleasing and more practical if the flute extends below fingerboard level as shown in FIGS. 5 and 6. In FIG. 4 the nut 40 has second or fluted sections 41 which extend down to the fingerboard level 42. Because of the deeper flutes 51 and 61 in FIGS. 5 and 6, comparable sections or flutes 52 and 62 are formed into the fingerboard 53 and 63. This same fluted design applies to the lateral sections of the nut 54 and 64.

Viewed from different terminology, the nut body comprises a single, integral structure 60 having string support means 65 which position and retain the strings 66 at proper position with respect to the fingerboard 63. These support means comprise columns which are separated by open spaces 61 which occupy most of the volume between the respective strings, below string level and above fingerboard level. As illustrated in FIG. 6, this open space may extend well below fingerboard level and into the fingerboard 62 as well.

The diverging column structure 65 acts as a megaphone, carrying vibrations from the narrow crown at the strings 66 into the broader base of the column and into the merging base of the nut body and fingerboard.

Another measurement perspective for the fluted portion between the strings is defined in terms of string separation distance. Specifically, the depth of the flute should be at least as deep as the separating distance between the strings. This design will depend on the total height of the nut and its stuctural ability to maintain its strength to support the string tension.

Figure 7:
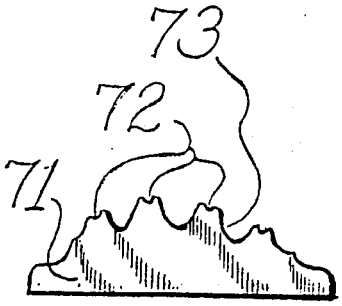
FIG. 7 is a graphic representation of the nut for a cello.
Figure 8:
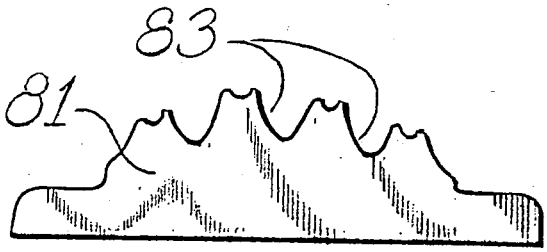
FIG. 8 is a graphic representation of the nut for a bass violin.

Although variations of the nut configuration will be necessary for different members of the string family, the general principles apply. For example, a cello nut FIG. 7 has a broader base 71. Because string separation distances 72 are greater, flute depth 73 is likewise deeper. Similar considerations extend to the larger bass nut shown in FIG. 8. The base 81 and depth 83 are even more broad. Because of the larger size of the cello and bass deeper flutes may also be formed into the fingerboard adjacent the nut.

Figure 9:
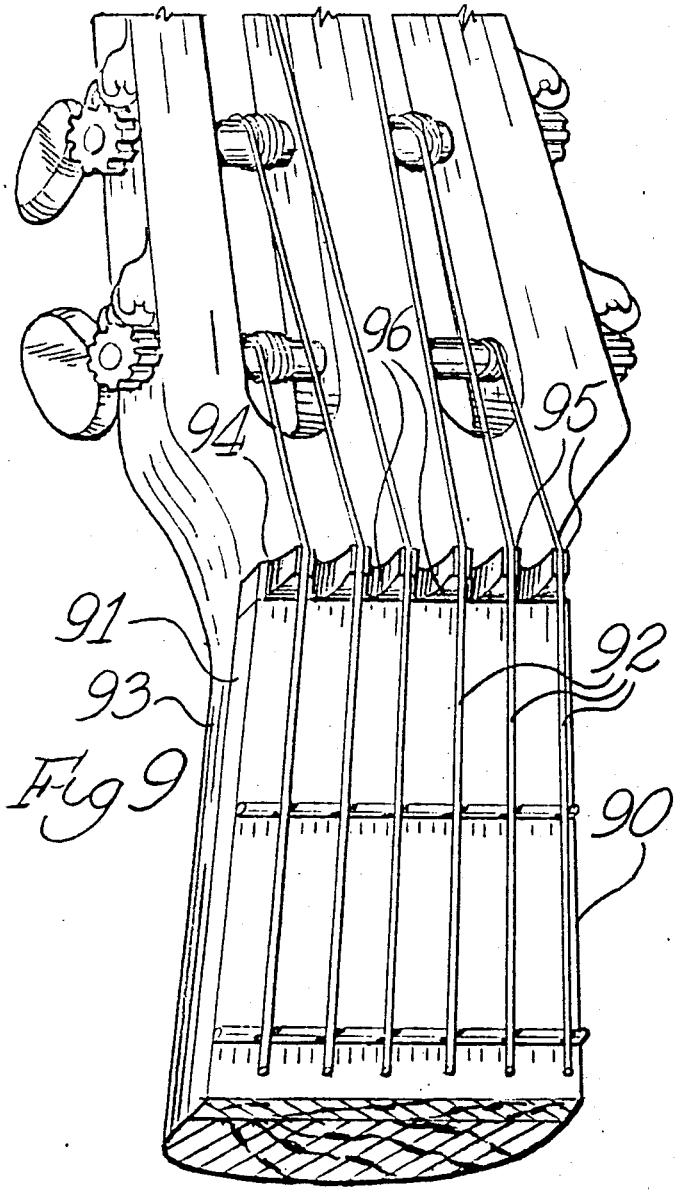
FIG. 9 depicts a perspective view of the upper section of a guitar with improved nut.
Figure 10:
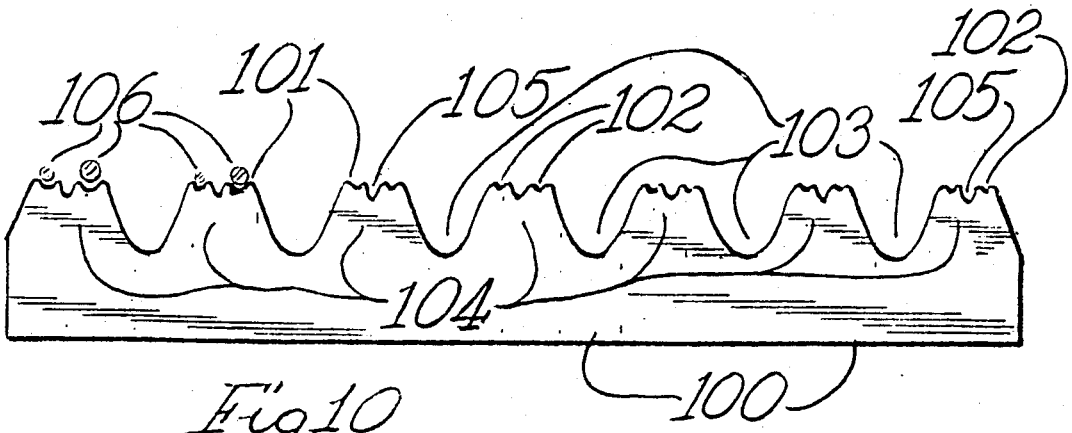
FIG. 10 shows a graphic cross section of a twelve string guitar nut structured in accordance with the present invention.

Similarly, the improved nut may be applied to other types of stringed instruments. This same nut design can be applied to the nut of a guitar as illustrated in FIG. 9. The Figure illustrates an upper section of a guitar 90 having a fingerboard 91 and six strings 92 mounted in conventional manner above the neck 93 of the instrument. The improved nut 94 is structured with six string support means 95 which are respectively separated by a second section 96 which comprises an open space as previously designed for the string instruments of the violin family. The nut construction with respect to the first and second sections is substantially the same as disclosed for the other nut configurations, except that the nut has a straight crown, as opposed to the arced or curved crown of the violin family. This is disclosed in FIG. 10, which shows a graphic cross section of a 12 string guitar. The nut body 100 includes the crown 101 with 12 grooves 102 to support the 12 guitar strings. The second or open section 103 is spaced between six string support means 104. A second open section 105 is cut between the two grooves 102 and each string support means 104 to the extent possible without jeopardizing the strength of each groove 102. Sample strings 106 are illustrated on two strings support means 104 at the left of the figure.

Figure 11:
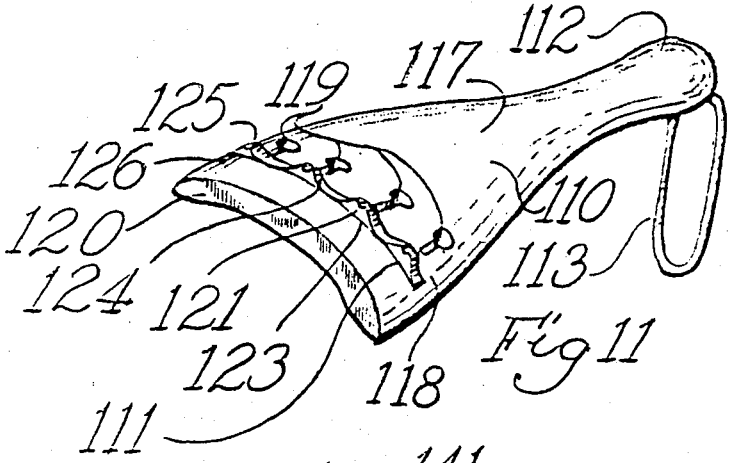
FIG. 11 depicts a perspective view of a tail piece for a member of the violin family having a modified nut section in accordance with the present invention.
Figure 12:
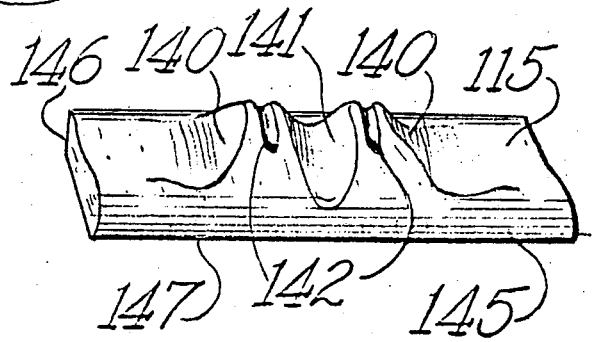
FIG. 12 is a perspective view of a saddle also having a modified nut section.
Figure 13:
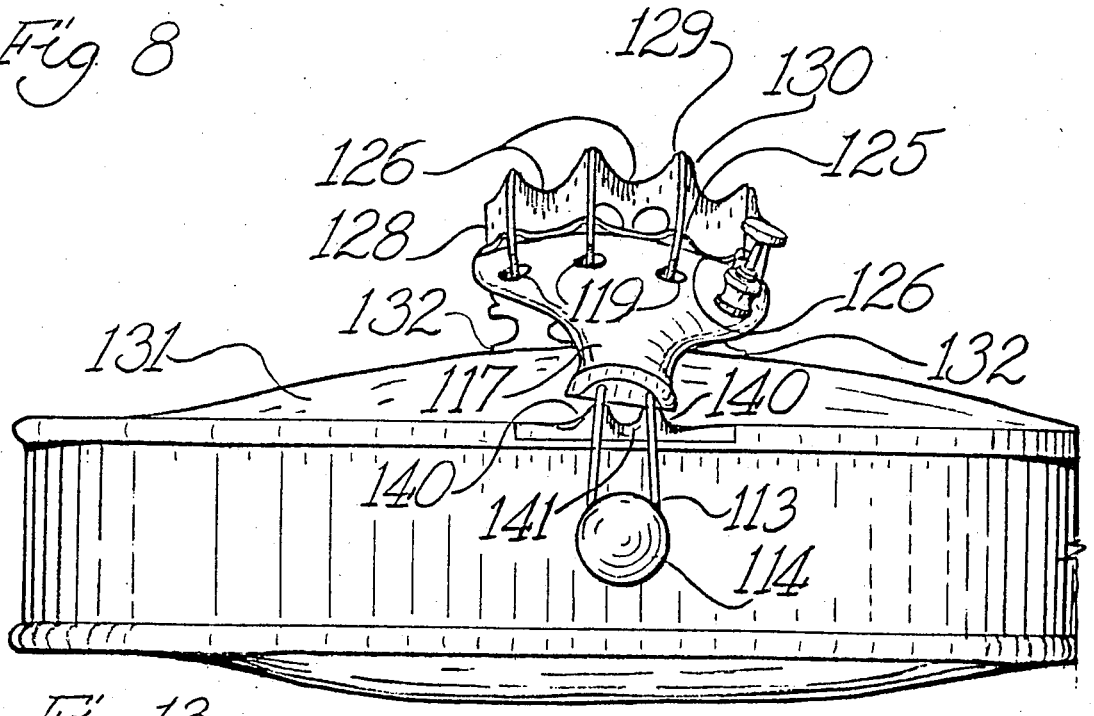
FIG. 13 illustrates an end view of a stringed instrument having the saddle and tail piece modified as shown in FIGS. 10 and 11.

The inventor has further discovered that other terminal supports for strings on the violin family such as the tail piece (FIG. 11) and the saddle (FIG. 12) can be utilized to enhance sound generation. The nut design set forth above can be applied to the tail piece 110 as illustrated at item 111. As shown, the tail piece body includes a distal end 112 having a loop 13 or other means for attachment to a bottom portion of the instrument such as a tail pin or end post. Typically, this attachment means 113 is a piece of gut which loops around a tail pin or end post 114 as shown in FIG. 13. Other materials such as nylon, steel, etc., may be used as well. This attachment means 113 is referred to herein and in the claims as a vibrational strand which is supported across a saddle 115.

The tail piece 110 further includes an intermediate section 117 and a string attachment end 118. The string attachment end 118 includes means 119 for securing each of the respective playing strings at an inward portion from the remaining end 120 of the tail piece. The illustrated securing means comprise slots or holes 119 through the tail piece, which anchor ends of the playing strings.

The string attachment end 118 further includes a raised nut section 111 positioned between the securing means 119 and the end 120 of the tail piece. The purpose of this raised nut 111 is to position each of the attached strings above the tail piece body and to provide enhanced sound transfer therethrough. The nut section 111 includes a front face 121, an opposing back face 122, a base 123 for secure mounting of the nut section to a top portion of the tail piece, and a crown 124 having string support means 125 for positioning and retaining the strings at properly spaced distances with respect to adjacent strings and above the tail piece body. A fluted portion 126 is positioned between each of the string support means 125 in accordance with the same principles set forth for the nut for the violin family. The assembled configuration of the tail piece with a saddle is shown in end view in FIG. 13, which also includes a bridge 128 similarly modified with alternating string support means 129 and fluted open space 130. Item 131 is the front resonating face of the instrument, which supports the feet 132 of the bridge 128.

As previously indicated, the saddle 115 can also be modified with the string support means 140 and an intermediate flute or open section 141. Grooves' 142 provide a secure position to the vibration strand or gut 113.

Similar to other nut configurations, the saddle 115 has a front face 145, a back face 146, a base 147 and a crown 148. The crown is formed of two separate alternating sections as indicated, the string support means 140 and the fluted portion 141. The size of the fluted portion is maximized to the greatest extent possible without jeopardizing the strength of the adjacent string support columns.

Figure 14:
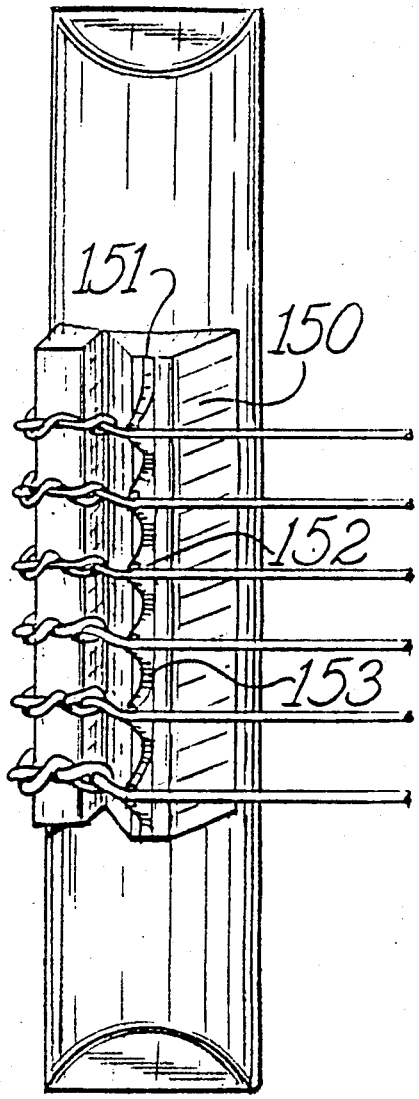
FIG. 14 provides a perspective view of a guitar bridge constructed within the concept of the present invention.

FIG. 14 illustrates an additional embodiment of the present invention which is incorporated into the bridge structure of a guitar. It will be noted that the bridge has a similar configuration to the tail piece and saddle of the violin family. The nut section or nut body 151 or the guitar bridge is substantially configured in the same manner as the nut of the guitar 94 in FIG. 9. Duplication of that description is deemed unnecessary. In short, the nut body 151 is mounted within a bridge support base 150 by means of a slot or other mounting structure and includes the two section design comprising string support means 152 and an open fluted section 153, configured in alternating arrangement.

The common feature of string nut design set forth above involves the use of the alternating string support column and open, fluted section there between. The inventor is uncertain as to the exact cause for the significant improvement in sound when utilizing this invention. However, the refinement of sound transfer at the extreme ends of the strings clearly generates substantial enhancement to sound quality. It will be apparent to those skilled in the art that other variations from those embodiments disclosed above can likewise be envisioned and derived from the inventive concepts set forth herein. Accordingly, it is to be understood that the scope of this invention is not limited to specific embodiments shown and described, but is to be limited in accordance to the following inventive claims.

I claim:

1. An improved nut for positioning near the fingerboard of a stringed instrument and for supporting strings of the instrument above a level of the fingerboard, said nut comprising:

a nut body configured for snug fit with respect to the fingerboard and neck of the instrument, said body having a front face for placement proximate to the fingerboard, a back face, a base for secure mounting of the nut with respect to the neck of the instrument and a crown having string support means for positioning and retaining the strings at properly spaced distances with respect to adjacent strings and above the fingerboard;

the crown of the nut being formed of two separate alternating sections wherein the first section comprises the string support means positioned at appropriate heights above the level of the fingerboard for proper positioning of strings;

the second section of the nut comprising a fluted portion between at least two adjacent string support means wherein most of the space between (i) the two adjacent strings, (ii) the front and back nut faces and (iii) the level of the fingerboard and level of the strings is void of nut material;

the string support means being thereby adapted for receiving and transmitting increased vibrational energy from the string into the neck and fingerboard of the instrument.

2. An improved nut as defined in claim 1, wherein each space of the nut between adjacent strings of the instrument includes a second section having a fluted portion wherein most of the defined space between each of the adjacent strings is void of nut material.

3. An improved nut as defined in claim 1, wherein lateral portions of the nut adjacent to each of two outside single strings of the instrument comprise a second section as defined having a fluted portion wherein most of the space between (i) the single string and the adjacent side face of the nut, (ii) the front and back nut faces and (iii) the level of the fingerboard and level of the strings is void of nut material.

4. A nut as defined in claim 1, wherein the second section comprises a space formed between converging side walls of the string support means into the crown of the nut between at least two adjacent strings.

5. A nut as defined in claim 1, wherein the second section comprises an arcuate flute formed into the crown of the nut between at least two adjacent strings.

6. An improved nut as defined in claim 1, wherein the string support means comprises a groove traversing the crown of the nut and configured to support the string to be journalled therein and further including side support structure adjacent to the groove to reinforce string support offered at the groove.

7. An improved nut as defined in claim 6, wherein the string support means is narrow at a top portion thereof, and diverges to form a broader support base as the support means approaches the fingerboard level.

8. A stringed instrument including a fingerboard and nut as defined in claim 1, wherein the void space of the second section of the nut extends below the level of the fingerboard.

9. A stringed instrument as defined in claim 8, wherein a section of the fingerboard adjacent to the nut includes a fluted section wherein a portion of the fingerboard between two adjacent strings is removed to provide a continuation of the fluted second section of the nut.

10. A stringed instrument as defined in claim 8, wherein a section of the fingerboard adjacent to the nut includes a fluted section at side edges thereof wherein a portion of the fingerboard lateral to a single string is removed to provide a continuation of a lateral fluted second section of the nut.

11. An improved nut for positioning near the fingerboard of a stringed instrument and for supporting strings of the instrument above a level of the fingerboard, said nut comprising:

a nut body being a single, integral structure and configured for snug fit with respect to the fingerboard and neck of the instrument, said body having a front face for placement proximate to the fingerboard, a back face, a base for secure mounting of the nut with respect to the neck of the instrument and having string support means for positioning and retaining the strings at properly spaced distances with respect to adjacent strings and above the fingerboard;

said string support means comprising columns at each string position, each column being separated from an adjacent column by an open space which occupies most of the volume between the respective strings, below string level and above fingerboard level.

12. An improved nut as defined in claim 11, wherein the open space between strings extends from string level to a position below the level of the fingerboard.

13. An improved nut as defined in claim 11 wherein the string support columns diverge from a string contacting face at a crown portion of the nut to a more broad support base toward the base of each column which merges with the base of the nut.

14. An improved nut as defined in claim 11, wherein the depth of the open space into the nut between two adjacent strings is approximately equal to the distance separating the two strings.

15. An improved saddle for positioning near the bottom end of a stringed instrument body and for supporting strings of the instrument above the body of the instrument, the saddle comprising:

a saddle body configured for snug fit with respect to the body of the instrument, said saddle body having a front face for placement toward the strings of the instrument, a back face, a base for secure mounting thereof with respect to the body of the instrument and a crown having support means for positioning and retaining vibrational strands in vibrational contact with the bottom portion of the instrument body;

the crown of the saddle being formed of two separate alternating sections wherein the first section comprises the string support means positioned at appropriate heights above the instrument body;

the second section of the saddle comprising a fluted portion between at least two adjacent string support means wherein most of the space between (i) the two adjacent strings, (ii) the front and back faces and (iii) the instrument and level of the strings is void of saddle material;

the string support means being thereby adapted for receiving and transmitting increased vibrational energy from the string into the bottom portion of the instrument.

16. An improved tail piece assembly for securing strings of a stringed instrument at a saddle and for supporting strings of the instrument above the body of the instrument, said tail piece assembly comprising:

a tail piece having (i) a distal end with means for attachment to a bottom portion of the instrument by a vibrational strand supported across a saddle, (ii) an intermediate section and (iii) a string attachment end including means for securing each of the respective playing strings at an inward portion from the remaining end of the tail piece;

the string attachment end further comprising a raised nut section between the securing means and end of the tail piece for positioning the attached strings above the tail piece, said nut section including a front face, a back face, a base for secure mounting of the nut section to a top portion of the tail piece and a crown having string support means for positioning and retaining the strings at properly spaced distances with respect to adjacent strings and above the tail piece;

the crown of the nut being formed of two separate alternating sections wherein the first section comprises the string support means positioned at appropriate heights above the level of the tail piece for proper positioning of strings;

the second section of the nut section comprising a fluted portion between at least two adjacent string support means wherein most of the space between (i) the two adjacent strings, (ii) the front and back nut faces and (iii) the tail piece and level of the strings is void of nut material;

the string support means being thereby adapted for receiving and transmitting increased vibrational energy from the string into the saddle and tail piece of the instrument.

17. An improved nut section in a guitar bridge, said nut section comprising a nut body configured for mounting to a support base, said nut body having a front face, a back face and a base for mounting of the nut in the support base;

said nut body further including a crown having string support means for positioning and retaining the strings at properly spaced distances with respect to adjacent strings and above a fingerboard of a guitar;

the crown of the nut body being formed of two separate alternating sections wherein the first section comprises the string support means positioned at appropriate heights above the support base for proper positioning of the strings;

the second section of the nut body comprising a fluted portion between at least two adjacent string support means wherein most of the space between (i) vertical planes passing through the two adjacent strings, (ii) the front and back nut faces and (iii) the level of the bridge support and level of the strings is void of nut material;

the string support means being thereby adapted for receiving and transmitting increased vibrational energy from the string into the support base.

* * * * *